US010228659B2

(12) United States Patent
Alagon Carrillo et al.

(10) Patent No.: US 10,228,659 B2
(45) Date of Patent: Mar. 12, 2019

(54) SAFETY REGULATION FOR A TIMEPIECE ESCAPEMENT

(71) Applicant: Montres Breguet S.A., L'Abbaye (CH)

(72) Inventors: Sebastian Alagon Carrillo, Romainmotier (CH); Benoit Legeret, Ecublens (CH); Davide Sarchi, Zurich (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 15/373,003

(22) Filed: Dec. 8, 2016

(65) Prior Publication Data

US 2017/0176938 A1 Jun. 22, 2017

(30) Foreign Application Priority Data

Dec. 18, 2015 (EP) ..... 15201020

(51) Int. Cl.
*G04B 15/10* (2006.01)
*G04B 17/06* (2006.01)
(Continued)

(52) U.S. Cl.
CPC ..... *G04C 5/005* (2013.01); *G04B 15/10* (2013.01); *G04B 17/06* (2013.01); *G04B 17/30* (2013.01); *G04B 21/06* (2013.01)

(58) Field of Classification Search
CPC ..... G04B 15/10; G04B 17/30; G04C 3/10; G04C 3/101; G04C 3/102; G04C 3/104;
(Continued)

(56) References Cited

U.S. PATENT DOCUMENTS 3,435,311 A * 3/1969 Matsuzawa ..... G04C 3/00 310/37
3,678,307 A * 7/1972 Clifford ..... G04C 3/105 310/22
(Continued)

FOREIGN PATENT DOCUMENTS

CH 704 457 A2 8/2012
CH 709 018 A2 6/2015
(Continued)

OTHER PUBLICATIONS

European Search Report dated Jun. 20, 2016 in European Application 15201020.3 filed on Dec. 18, 2015 (with English Translation of Categories of Cited Documents).

*Primary Examiner* — Daniel P Wicklund
(74) *Attorney, Agent, or Firm* — Oblon, McClelland, Maier & Neustadt, L.L.P.

(57) ABSTRACT

Mechanism for regulating energy to achieve the function of a timepiece mechanism including a functional mobile component, controlling a dissipation of energy through eddy currents in the event of racing by this mobile component, including a magnetically permeable or magnetized rotor kinematically connected to this mobile component, and a magnetized or respectively magnetically permeable stator, facing this rotor in an annular area where these eddy currents develop, this rotor and this stator are external to each other, this rotor and/or this stator including an alternation of raised areas where it can move into superposition with the other in an interaction generating eddy currents, and hollow areas in which it cannot move into superposition with the other. Escapement mechanism including such a regulating mechanism, limiting the effect of accelerations on an escape wheel.

13 Claims, 4 Drawing Sheets

(51) Int. Cl.
*G04B 17/30* (2006.01)
*G04B 21/06* (2006.01)
*G04C 5/00* (2006.01)

(58) Field of Classification Search
CPC ..... G04C 3/105; G04C 3/107; G04C 3/108; G04C 5/00; G04C 5/005
See application file for complete search history.

(56) References Cited

U.S. PATENT DOCUMENTS 3,737,746 A * 6/1973 Cielaszyk ..... G04C 3/14 310/37
3,816,779 A * 6/1974 Lundin ..... G04C 13/10 310/37
3,824,781 A * 7/1974 Diersbock ..... G04C 13/11 368/155
3,940,645 A * 2/1976 Takita ..... G04C 13/11 257/E21.076
3,999,369 A * 12/1976 De Valroger ..... G04C 3/00 310/36
2007/0201317 A1* 8/2007 Houlon ..... G04C 3/066 368/281
2012/0147715 A1 6/2012 Karapatis et al.
2012/0207001 A1* 8/2012 Pittet ..... G04B 17/30 368/243
2015/0177697 A1 6/2015 Di Domenico et al.
2015/0177698 A1 6/2015 Di Domenico et al.

FOREIGN PATENT DOCUMENTS

EP 2 463 732 A1 6/2012
EP 2 891 930 A2 7/2015
FR 2 768 242 A1 3/1999
JP 58-221182 12/1983

* cited by examiner

SAFETY REGULATION FOR A TIMEPIECE ESCAPEMENT

This application claims priority from European Patent application 15201020.3 of Dec. 18, 2015, the entire disclosure of which is hereby incorporated herein by reference.

FIELD OF THE INVENTION

The invention concerns a regulating mechanism for dissipating energy superfluous to the achievement of the function of a timepiece mechanism including a functional wheel set.

The invention also concerns an escapement mechanism including such a regulating mechanism.

The invention also concerns a timepiece movement including at least one such regulating mechanism.

The invention also concerns a watch including such a movement, and/or at least one such regulating mechanism.

The invention concerns the field of timepiece mechanisms intended to be incorporated in a watch or in a mobile device.

BACKGROUND OF THE INVENTION

Improving the efficiency of an escapement mechanism is a constant preoccupation in the watch industry. To this end, it is generally sought to minimise dissipation of any kind in an escapement, since dissipations are difficult to control and impair the efficiency of the oscillator. In particular, dissipation through accelerations, notably due to the actual working of the mechanism or through accelerations of external origin, particularly from shocks, and dissipation through friction are harmful and difficult to control.

Currently no system of controlled dissipation is used in escapement mechanisms.

CH Patent 704457 in the name of MONTRES BREGUET SA discloses a regulator for a timepiece wheel set or striking work, for regulating the pivoting speed, about a first pivot axis, of a wheel set comprising an inertia-block pivoting about a second pivot axis parallel to the first. This regulator includes means for returning the inertia-block to the first axis. When the wheel set pivots at a speed lower than a reference speed, the inertia block remains confined within a first volume of revolution about the first axis. When the wheel set pivots at a speed higher than the reference speed, the inertia-block engages, at least on a peripheral portion thereof, in a second volume of revolution about the first axis, contiguous and external to the first volume of revolution. This peripheral portion cooperates inside the second volume of revolution with regulating means arranged to cause the braking of the wheel set and to return the pivoting speed to the reference speed, and to dissipate any excess energy. This mechanism thus describes a system for regulation to an operating or reference speed, via a device which reduces speed/torque dependency.

EP Patent 2891930 in the name of THE SWATCH GROUP RESEARCH & DEVELOPMENT LTD describes a device for regulating the relative angular velocity between a magnetic structure and a resonator which are magnetically coupled to define together an oscillator, in particular with a magnetic escapement. The magnetic structure includes at least one annular path formed of a magnetic material of which one physical parameter is correlated to the magnetic potential energy of the oscillator, the magnetic material being arranged on the annular path so that the physical parameter varies angularly in a periodic manner. The annular path includes, in each angular period, an area of accumulation of magnetic potential energy in the oscillator, adjacent to an impulse area. The magnetic material in each accumulation area is arranged so that the physical parameter of the magnetic material gradually increases angularly or gradually decreases angularly so that the magnetic potential energy of the oscillator increases angularly during a rotation of the magnetic structure relative to the resonator.

SUMMARY OF THE INVENTION

Dissipation in an escapement is generally minimised, since this defines the efficiency of the oscillator. However, by controlling the instants of appearance and of disappearance of friction related to a particular function, it is possible to preserve the efficiency of the mechanism concerned, while utilising the dissipation for functional or acoustic or even aesthetic applications.

In an escapement mechanism in which the escape wheel is conventionally driven by a barrel, the torque communicated by the barrel varies as it unwinds, the energy transmitted to the escapement is lower after several hours of operation than just after winding. Likewise, there is a variation in torque, and thus in energy, dependant on the gear trains, due especially to profile differences, and tribological phenomena. For an escapement to achieve constant force, it is advantageous for energy to be rendered superfluous after a certain torque, by dimensioning a suitable mechanism; this is the operating mode of a magnetic escapement. This energy rendered superfluous by the operation of the escapement must, however, be dissipated in one manner or another. More generally, in any conventional escapement, the kinematic energy of the pallet-lever after the impulse, before stopping against the solid banking, is superfluous energy.

The present invention endeavours first to act on accelerations due to the actual working of the mechanism, through an arrangement that also has the advantage of limiting the undesirable effect of accelerations imparted by an external factor.

Application of the principle of controlled dissipation to an escape wheel makes it possible to obtain a wheel that slows down gradually after the impulse function. The advantages that result therefrom are:

a more continuous operation, less repercussion of the drop impact in the other gear trains, a drop impact that is less audible to the wearer, a drop impact that is spaced further apart from the impacts of the other functions during measurement (ease of measurement), less rebound of the escape wheel against the pallet-stones, less wear.

Currently, no system of controlled dissipation is used in an escapement mechanism. Dissipation through untimely accelerations, shocks and friction on constant force escapements, which depend on tribology, is not controlled.

The magnetic regulator is the only system in which excess energy is dissipated through eddy currents, but its action depends on the torque applied and not on the positioning of the moving parts.

It is possible to envisage the use of other means of forced dissipation, for example through mechanical friction, through shocks, or through the use of an idler wheel friction driven by the gear train and which continues to rotate for a short time in the event of rebound due to its inertia, thereby increasing friction in the event of rebound. Once again, mechanical energy dissipations are difficult to control and to dimension.

Any escapement mechanism requiring dissipation of excess energy, and particularly any magnetic type escapement, benefits from incorporating a system wherein the amplitude and peak of dissipation are controlled. In a magnetic escapement, for example, this excess energy causes visible rebounds of the escape wheel against its magnetic banking, which risk causing variations in rate in the event of micro-shocks, and are less convenient from the aesthetic point of view.

The invention proposes to control energy dissipation in a timepiece mechanism including at least one stator and at least one rotor arranged to cooperate with each other, as a function of the respective angular positions between the stator and rotor, or the stators and rotors as appropriate.

The present invention proposes, more particularly but in a non-limiting manner, to use controlled dissipation through eddy currents, to dissipate all the excess energy in a single rebound.

To this end, the invention concerns a regulating mechanism according to claim 1.

The invention also concerns an escapement mechanism including such a regulating mechanism.

The invention also concerns a timepiece movement including at least one such regulating mechanism.

The invention also concerns a watch including such a movement, and/or at least one such regulating mechanism.

The system according to the invention may equally be placed in a conventional escapement, to take advantage of purely viscous friction, which dissipates much more energy before the drop, where the velocity of the wheel is maximum, and diminishes the intensity of the drop impact. The rebounds of the wheel against the pallet-stone, which are sometimes very considerable, can thus be minimised, and the risk of breakage of the wheel teeth can be avoided, in particular when it is made of silicon or another similar micromachinable material, or the risk of plastic deformation.

The invention is advantageous for control of isochronism. Indeed, the rebounds of the wheel in an escapement limit the frequency, since the next vibration must occur at a time when rebounds are reduced in order to avoid impairing the function. By quickly damping this friction it is possible to have vibrations closer in time, and thus to achieve a higher oscillator frequency, which consequently produces better adjustment power.

Another application of the invention consists in a system for fine adjustment of the amplitude of a balance. Indeed, it is important, when calculating the dimensions of an oscillator, not to devise an operating amplitude that is too high, which risks causing problems of knocking during operation of movements. With an eddy current brake system according to the invention, in which penetration, and therefore dissipation, is adjustable by the watchmaker, it is possible to devise balances operating at high amplitude, with no risk of knocking, and with very low dispersion in production.

BRIEF DESCRIPTION OF THE DRAWINGS

Other features and advantages of the invention will appear upon reading the following detailed description, with reference to the annexed drawings, in which:

FIGS. 6 and 7 represent configurations of radially disposed reliefs and hollows, and two different configurations of conductive and magnetized parts; FIG. 8 includes axially disposed hollows and reliefs.

DETAILED DESCRIPTION OF PREFERRED EMBODIMENTS

Figure 1:
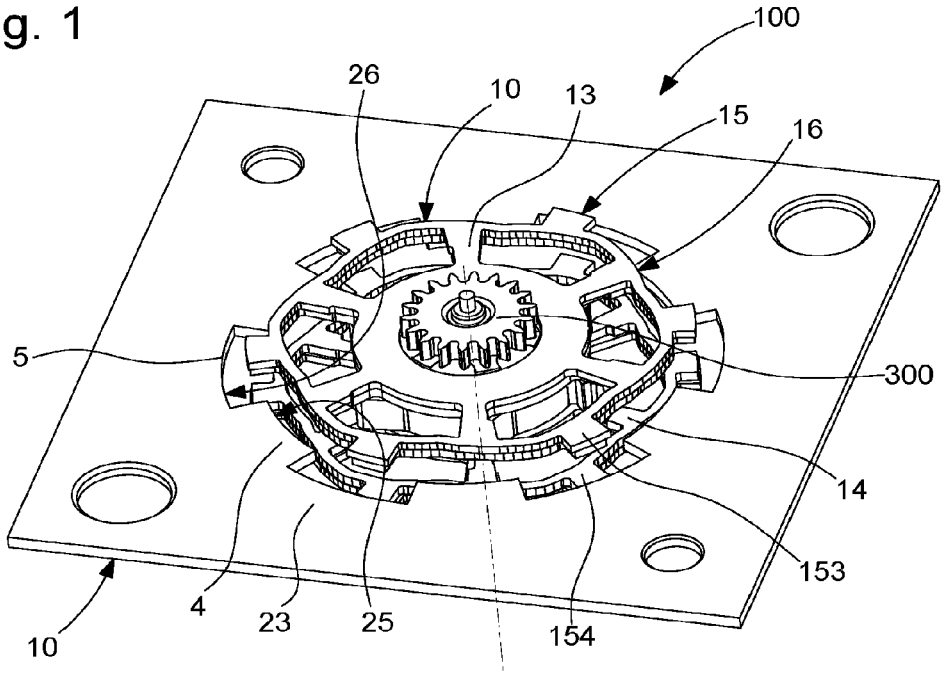
FIG. 1 represents a schematic, perspective view of a first variant of a magnetic escapement with two paths, between which is disposed a yoke for an eddy current brake.

The invention proposes to control energy dissipation in a timepiece mechanism including at least one stator and at least one rotor arranged to cooperate with each other, as a function of the respective angular positions between the stator and rotor, or the stators and rotors as appropriate.

The invention applies both to the usual case where at least one of the opposing components, conventionally the stator, is fixed, and to the case where the rotor is a mobile component or a wheel set belonging to a first mechanism, and the stator is another mobile component or wheel set belonging to a second mechanism.

To control these variations in the respective angular positions, a preferred implementation of the invention which is more precisely described here, but in a non-limiting manner, consists in utilising, in a timepiece mechanism dedicated to a particular function, the properties of eddy currents to dissipate, in a targeted manner, the energy that is unnecessary for the achievement of this particular function.

The invention also endeavours to allow the watchmaker to effect a fine adjustment of the impact (positioning) of the dissipating elements.

In particular variants, such a fine adjustment can also be controlled by the movement itself, as a function of the remaining power reserve, or of any other pertinent operating parameters.

Thus, the invention concerns a regulating mechanism 100 for dissipating energy superfluous to the achievement of the function of a timepiece mechanism 200 including a functional mobile component 300, more particularly a wheel set, and particularly capable of limiting the effect of accelerations due to the actual operation of mechanism 200, and the effect of untimely accelerations of external origin, notably shocks, on such a functional mobile component 300.

According to the invention, this regulating mechanism 100 is arranged to control a dissipation of energy if functional mobile component 300 races. Regulating mechanism 100 includes at least one rotor 10, which is kinematically connected to functional mobile component 300, or which is formed by functional mobile component 300 or is integral therewith.

This rotor 10 includes either a conductive rotor part 11 which is magnetically permeable, or a magnetized rotor part 12 which is magnetized.

Regulating mechanism 100 includes, in an annular area of magnetic interaction, in direct proximity to and opposite conductive rotor part 11, or respectively magnetized rotor part 12, at least one stator 20 arranged to cooperate with rotor 10.

Stator 20 then includes a magnetized stator part 21 which is magnetized, or respectively a magnetically permeable conductive stator part 22, depending on the arrangement of the rotor 10 with which it cooperates.

"Conductive material" means an electrical conductor, carrying electrical charges, such as copper, silver, or similar, according to the custom of the person skilled in the art.

In the annular area of magnetic interaction, at least rotor 10 or stator 20 includes at least one raised area 15, 25, in which rotor 10 or stator 20 is capable of moving into superposition respectively with stator 20, or rotor 10, in a magnetic interaction. And, in this same annular area, at least rotor 10 or stator 20 includes at least one hollow or recessed area 16, 26, in which rotor 10 or stator 20 cannot move into magnetic interaction with stator 20, or rotor 10 respectively. The dissipation of energy depends on the relative angular position of rotor 10 and stator 20, and can only occur when solid parts of rotor 10 and of stator 20 are facing each other in the annular area.

More particularly, regulating mechanism 100 is arranged to control a dissipation of energy through eddy currents if functional mobile component 300 races, in the annular area.

More particularly still, at least rotor 10 or stator 20 includes an alternation of such raised areas 15, 25, in which rotor 10 or stator 20 is capable of moving into superposition with stator 20, or rotor 10 respectively, in an interaction generating eddy currents. Further, at least rotor 10 or stator 20 includes an alternation of such hollow areas 16, 26, in which rotor 10 or stator 20 is not capable of moving into superposition with stator 20 or rotor 10 respectively, and where the interaction between rotor 10 and stator 20 cannot generate eddy currents.

The velocity of rotor 10 depends on the mechanism 200 to be regulated. However, the object of the invention is not to regulate the velocity of this rotor, but to dissipate energy when an abnormal acceleration is imparted to mechanism 200.

The invention is described here more particularly for application to an escapement mechanism. This application is not limiting.

In this application to an escapement mechanism 200, the velocity of rotor 10 depends on the velocity of an escape wheel 3 comprised in escapement mechanism 200. Conductive rotor part 11, or magnetized rotor part 12, may form all or part of the actual escape wheel 3.

The first variant of FIG. 1 presents an application of the system to an escapement mechanism 200 of the magnetic type, including two magnetized rotor parts 12, which are an upper wheel 13 and a lower wheel 14, which are coaxial and parallel here, inside the air gap of which is arranged a yoke 23 forming a conductive stator part 22. This yoke 23 includes a peripheral alternation of teeth 4 and notches 5. Upper wheel 13 and a lower wheel 14 also include peripheral teeth, respectively 153 and 154. Teeth 4 of yoke 23 are arranged, in certain relative positions, to move opposite and in immediate proximity to teeth 153 or 154, allowing the generation of eddy currents and the controlled dissipation of energy. Each of notches 5 of yoke 23 is arranged to prevent interaction between the material of yoke 23 and the teeth 153 or 154 which are facing the notch 5 concerned. Teeth 4 and notches 5 of yoke 23 thus control the angular dependence of dissipation, which can then be designed to be maximum in the event of rebounds. The choice of the material, of the thickness and of the penetration of conductive rotor part 11 make it possible to calculate the intensity of dissipation, which can be chosen to operate at critical damping, stopping without any rebound.

Figure 3:
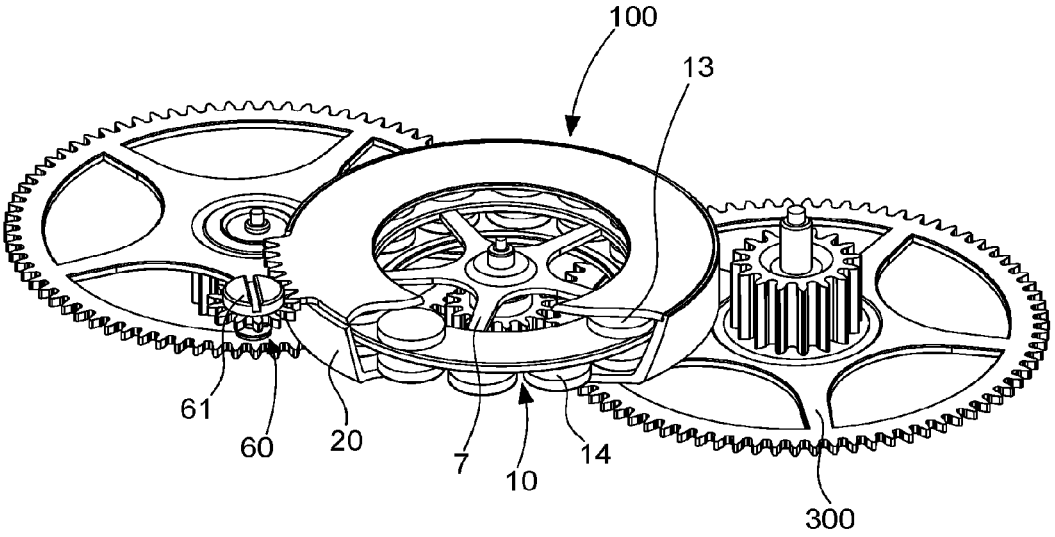
FIG. 3 represents, in a similar manner to FIG. 1, a third variant with an eddy current brake without angular dependence of dissipation, located on an additional wheel set with a fine adjustment system for watchmakers.
Figure 4:
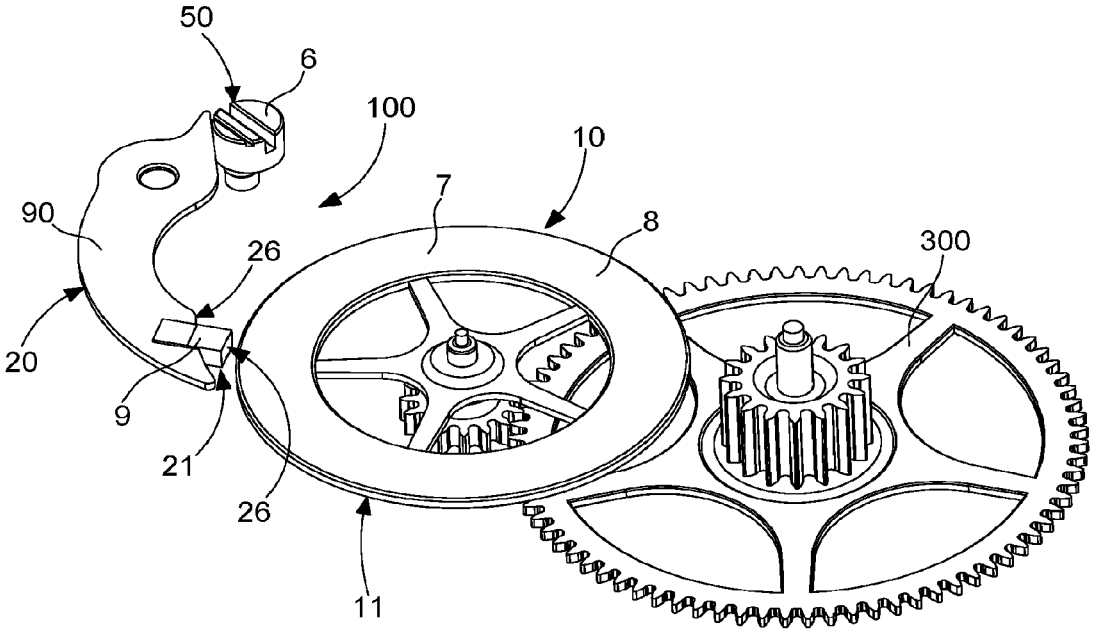
FIG. 4 represents, in a similar manner to FIG. 1, a fourth variant with a magnetic brake with fine adjustment, in an application to the radial magnetization of magnetic components, and on an additional wheel set.

It is possible to place such a device on at least one additional wheel set 7, connected to the escapement by a set of gear trains, as seen in FIGS. 3 and 4. Such an embodiment on an additional wheel set 7 creates fewer space constraints, and can permit higher dissipation.

It is naturally possible to add several targeted dissipation systems, to several different wheel sets connected by a gear train. The advantage is to obtain higher dissipation and an averaging out of the defects of the various systems.

It is advantageous to be able to adjust the maximum intensity of the eddy currents, by adjusting the eddy current dissipation by a modification—manual or controlled by a mechanism—of the penetration or of the distance between the conductive and magnetized parts: conductive rotor part 11 cooperating with a magnetized stator part 21, or magnetized rotor part 12 cooperating with a conductive stator part 22.

An example embodiment according to the FIG. 1 diagram forms a minimum, non-optimised embodiment of the concept of the invention. An upper rotor wheel and a lower rotor wheel each include six teeth separated by notches having three times the angular amplitude of the teeth, whereas the stator yoke includes six teeth and six notches of the same amplitude. The thickness of the conductive stator part is 0.2 mm, and its conductivity is $5.998 \cdot 10^7$ S/m in the case of a copper embodiment. The upper and lower rotor wheels each have the size of an ordinary timepiece escape wheel, and the remanent field of the magnetic paths is at least 1 T. The distance between the magnets and the conductive part is at most 0.10 mm. The dissipated energy is thus on the order of 0.25 μJ·ms, in a very simple embodiment where the conductive part is subjected to a very low field. Of course, a solution with alternating magnetizations on an additional wheel set, notably as in FIG. 3, can substantially increase dissipation; the same applies with larger dimensions of the various components.

Magnetic escapement mechanisms are described in The Swatch Group Research and Development Ltd Patent Applications CH02140/13, CH01416/14 and CH01129/15, Nivarox-FAR SA Patent Applications CH01444/14 and CH 01445/14, and ETA Manufacture Horlogère Suisse Patent Applications CH01290/14 and CH01127/15, which are incorporated herein by reference.

Figure 2:
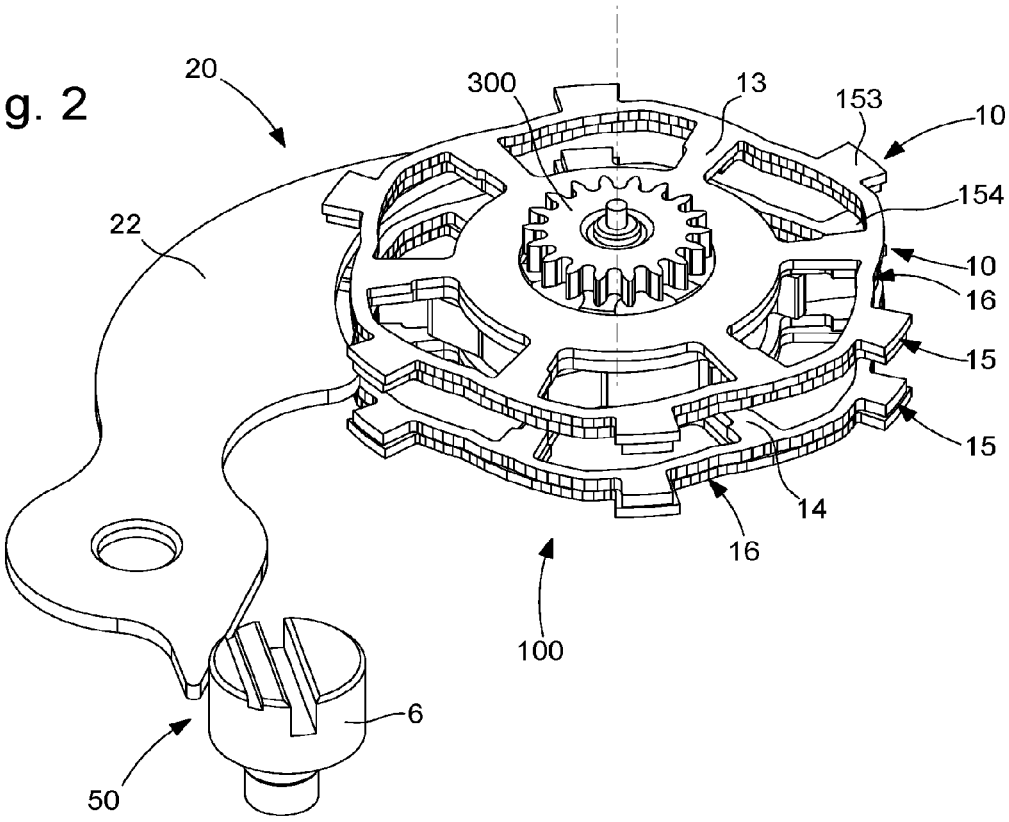
FIG. 2 represents, in a similar manner to FIG. 1, a second variant without angular dependence of dissipation, and with a fine adjustment system for watchmakers by adjustment of the penetration of a yoke in the air gap between the paths.

FIG. 2 represents a second variant, relating to an application wherein regulating mechanism 100 includes first means 50 for adjustment of the angular position of stator 20, formed here by an eccentric screw 6 which can adjust the penetration of the conductive stator part 22, limited here to an angular sector, in the air gap between an upper wheel 13 and a lower wheel 14.

A particular application concerns the fine adjustment of the amplitude of a balance wheel, through adjustment of the eddy current dissipation by a manual or controlled modification of the penetration or of the distance between the conductive part and the magnetized part, in the annular area, with such a device.

FIG. 3 presents a third variant, with a braking system without angular dependence, on an additional wheel set 7. In this type of wheel set the magnets have alternate axial magnetizations: N-S, S-N, N-S. This makes it possible to maximise the field variation, in angular dependence, and thus to maximise the variation in magnetic flux when the conductive part is in motion in the field of the magnets. Since the brake is proportional to flux variation, maximum braking is obtained when the magnets of the upper part are aligned with those of the lower part, N-S opposite N-S, and minimum braking when the magnets are in opposition, N-S opposite S-N. This variant permits high dissipation owing to great design freedom, since there is no direct impact on the escapement functions, unlike the variant of FIG. 2, and owing to the use of rare earth magnets.

More particularly, regulating mechanism 100 includes second means 60 for adjustment of the angular position of at least one of rotors 10 with respect to the others: a fine adjustment is achieved by turning either upper wheel 13 or lower wheel 14, formed here by plates of magnets, with respect to the other, with the aid of a control pinion 61, in order to de-index the magnets and to diminish the magnetic flux variation caused by a rotation of the wheel set. The rare earth magnets may or may not have an alternate direction of magnetization.

Such a mechanism can also be achieved using a conductive rotor part 11 cooperating with a magnetized stator part 21, or a magnetized rotor part 12 cooperating with a conductive stator part 22, which are arranged to move closer to each other axially, instead of varying penetration.

Modulation of the amplitude of dissipated energy may also be obtained through variation of the thickness of the conductive part or of the magnetized part. It is therefore possible to achieve such a mechanism, in particular, using a conductive rotor part 11 cooperating with a magnetized stator part 21, or a magnetized rotor part 12 cooperating with a conductive stator part 22, whose thickness varies, instead of varying penetration.

As regards variation of dissipation as a function of variation of thickness, dependence is virtually linear: by imparting a variation of thickness of 50%, there is obtained, in the aforecited example based on FIG. 1, a variation of dissipation close to 50%, which, combined with the high velocity of the escape wheel during the dissipation phase, is sufficient to dissipate superfluous energy originating from inside the mechanism. The extreme case of thickness variation is of course a variation of 100%, which corresponds to notches separating the teeth illustrated in the Figures. To take account of particular space constraints, constructions with non-axial, typically radial, magnetization of the magnetic components may be preferred.

FIG. 4 represents a fourth variant with a radial application, which is consequently more compact axially, with a conductive ring 8 forming a conductive rotor part 11, the distance of which is adjustable with respect to a magnet 9, which forms a magnetized stator part 21 and is carried by a lever 90 adjustable by an eccentric screw 6.

Figure 5:
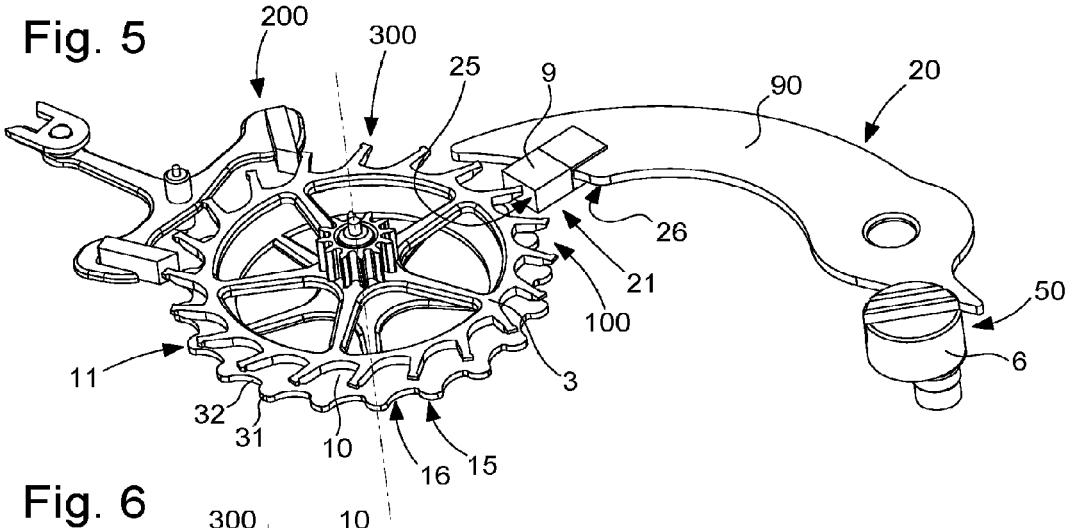
FIG. 5 represents, in a similar manner to FIG. 1, a fifth variant with a targeted magnetic brake, in a radial application, with angular dependence of dissipation.
Figure 6:
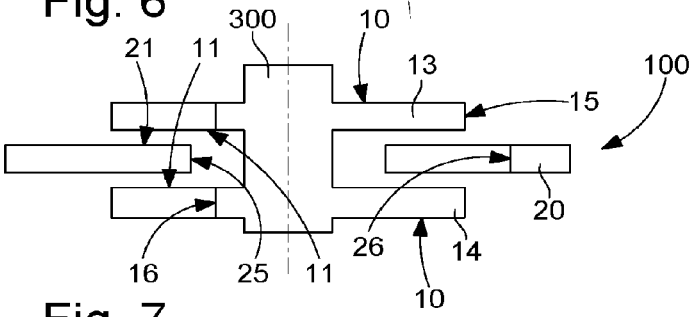
FIGS. 6 to 8 are schematic cross-sectional diagrams, passing through the axis of rotation of the wheel set.
Figure 7:
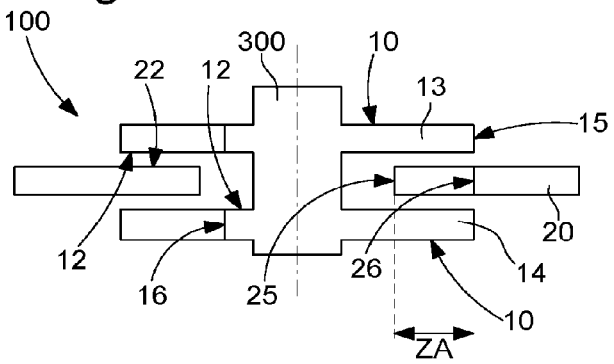
Figure 8:
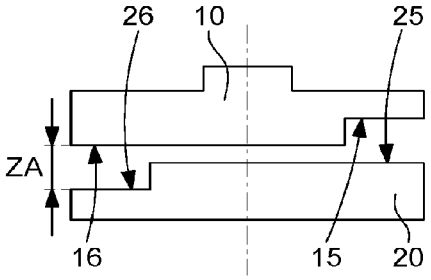
Figure 9:
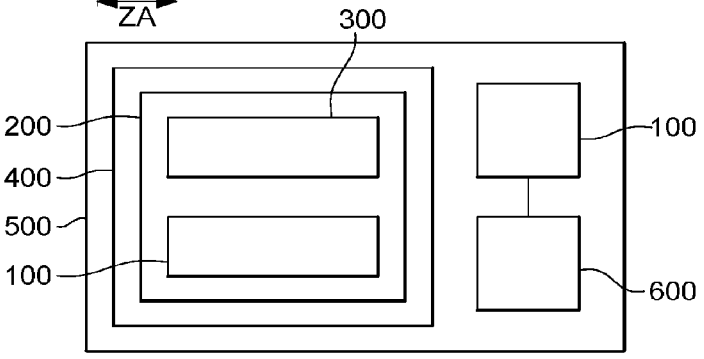
FIG. 9 is a block diagram representing a watch including a movement which in turn includes an escapement mechanism with a regulating mechanism according to the invention.

FIG. 5 presents a fifth variant with a radial system with fine adjustment, with a conductive rotor part 11 integral with an escape wheel 3, and with angular dependence of dissipation, obtained by a variable peripheral profile with reliefs 31 and hollows 32 on the periphery of conductive rotor part 11. Here too, a lever 90 which carries a magnet 9 that forms a magnetized stator part 21 is position adjustable, via an eccentric screw 6.

The invention more particularly concerns a timepiece escapement mechanism 200, including at least one escape wheel 300, and escapement mechanism 200 includes such a regulating mechanism 100, arranged to limit the effect of accelerations, particularly shocks, on the escape wheel 300.

The invention also concerns a timepiece movement 400 including at least one escapement mechanism 200 of this type.

The invention also concerns a watch 500 including at least one such timepiece movement 400, and/or at least one such regulating mechanism 100.

For example, watch 500 includes another mechanism 600, independent of movement 400, controlled by such a regulating mechanism 100.

The invention is also applicable to other mobile devices, such as devices for automobile, naval or air equipment, time-delay devices for munitions, or similar.

In order to protect the exterior of the watch, in particular the wearer and sensitive devices, against the magnetic fields of such a system, and to increase the efficiency of the system, it is possible and advantageous to add a ferromagnetic shield, not illustrated in the Figures.

Figure 10:
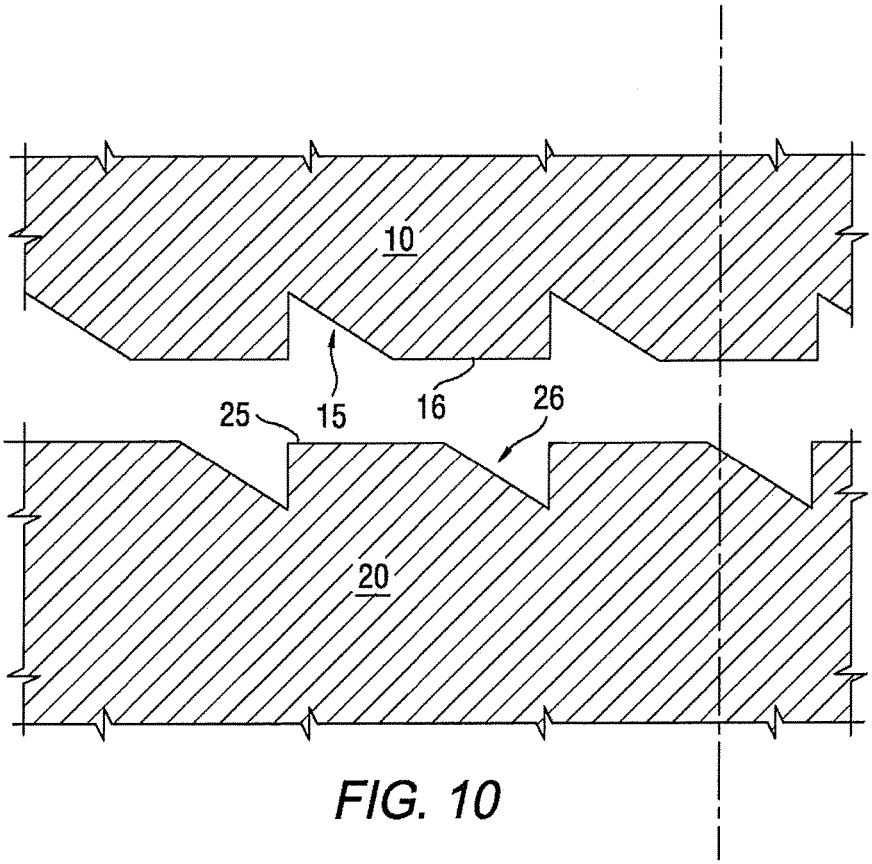
FIG. 10 represents a schematic radial view of a cross-section of hollows and reliefs illustrating an example embodiment of axial variations of the thicknesses.

The generation of eddy currents is connected to a field variation, the first being precisely generated by the second (local variation at best). In the variant of FIG. 1, via the wheel teeth and the recesses, the field varies in the same way that it would vary with a changing thickness (strictly speaking, even in the extreme case where the thickness varies between 0 and a fixed value). In FIG. 5 it is the radial thickness of the conductor and its proximity to the field which both vary; the same system can also be envisaged with an axial variation of thickness, as shown in FIG. 10.

It will be noted that the invention differs from the aforecited teaching of CH Patent 704457 in the name of MONTRES BREGUET SA, since the invention does not adapt to the imposed torque, but causes a purely viscous braking that depends on the position of the magnetic part with respect to the conductive part, and thus on the function in progress. However, a higher torque will always produce a higher operating speed. Further, no actual speed regulation occurs, it is rather a case of dissipating energy that is not actually used by the mechanism upstream or downstream.

The invention also differs considerably from the teachings of the aforecited EP Patent 2891930 in the name of THE SWATCH GROUP RESEARCH & DEVELOPMENT LTD, in which the principle of interaction is different from that of the invention (magnetic force with no induction effect) and the object of the device is to obtain a constant frequency via the magnetic excitation of an oscillator. The magnetic forces are used to transmit an impulse or a stop to the oscillating part.

A particularly advantageous embodiment of the invention is that wherein the magnetized part and the conductive part have a relief profile. No matter how it is desired to obtain a braking torque that varies during the function, it can be obtained by means of a relief profile of the two components. The manner in which this relief is achieved, for example radial or axial geometric variation of one part and/or the other, lack of magnetic or conductive material at certain angles, or other, may then vary according to the embodiment.

Although a particular use of the invention for an escapement is especially advantageous, the system can be used on other wheel sets, for example only for dissipating energy between take-offs of torque due to a striking work or similar.

In short, the invention provides numerous advantages:

the elimination of rebounds, without affecting efficiency, improved safety features, with improved operation in the event of micro-shocks, more continuous operation of the gear trains, fine adjustment of the amplitude of the oscillators, and notably allowing high amplitude without any risk of knocking, drop impacts that are less audible yet more easily identifiable, and spaced further apart from the impacts of the other functions, which provides a new ease of measurement, less wear, and less frequency limitation.

What is claimed is:

1. A regulating mechanism for dissipation of energy superfluous to achievement of a function of a timepiece mechanism including a functional mobile component, said regulating mechanism arranged to control a dissipation of energy in case of racing by said functional mobile component, said regulating mechanism comprising:

at least one rotor kinematically connected to said functional mobile component or formed by said functional mobile component, and including either a conductive rotor part which is magnetically permeable, or a magnetized rotor part which is magnetized; and on an annular area of magnetic interaction, in direct proximity and opposite to said conductive rotor part or respectively said magnetized rotor part, at least one stator including a magnetized stator part which is magnetized, or respectively a magnetically permeable conductive stator part, wherein, in said annular area of magnetic interaction, at least said rotor or said stator includes at least one raised area in which said rotor or said stator is movable so as to be superimposed respectively with said stator or said rotor in a direction parallel to a pivot axis of the rotor in a magnetic interaction, and in said annular area at least said rotor or said stator includes at least one hollow area, in which said rotor or said stator cannot move into magnetic interaction respectively with said stator, or said rotor, and wherein said regulating mechanism is arranged to control a dissipation of energy through eddy currents in said annular area in case of racing by said functional mobile component, the energy dissipation depending on the relative angular position of said rotor and said stator and only occurring when solid parts of said rotor and of said stator face each other in said annular area wherein the at least one raised area and/or the at least one hollow area has a variable thickness allowing modulation of the amplitude of dissipated energy.

2. The regulating mechanism according to claim 1, wherein at least said rotor or said stator includes an alternation of said raised areas, in which said rotor or said stator is movable into superposition respectively with said stator or said rotor in an interaction generating eddy currents, and wherein, at least said rotor or said stator includes an alternation of said hollow areas, in which said rotor or said stator is not movable into superposition respectively with said stator or said rotor, and wherein the interaction between said rotor and said stator cannot generate eddy currents.

3. The regulating mechanism according to claim 2, wherein, in said annular area, both said rotor and said stator include a succession of said raised areas, in which said rotor or said stator is movable into superposition respectively with said stator or said rotor, in an interaction generating eddy currents, and said hollow areas, in which said rotor or said stator is not movable into superposition respectively with said stator or said rotor, and wherein the interaction between said rotor and said stator cannot generate eddy currents.

4. The regulating mechanism according to claim 1, wherein said regulating mechanism includes an eccentric screw to adjust the angular position of said stator.

5. The regulating mechanism according to claim 1, wherein said at least on rotor includes a plurality of coaxial rotors at least two of which together define an air gap inside which is housed said stator.

6. The regulating mechanism according to claim 5, wherein said regulating mechanism includes a screw to adjust the angular position of at least one of said rotors with respect to the other of said rotors.

7. The regulating mechanism according to claim 1, wherein said hollow areas and raised areas extend in a plane perpendicular to the pivot axis of said rotor, to move said rotor and said stator radially closer or further away from each other.

8. The regulating mechanism according to claim 1, wherein said hollow areas and raised areas extend in a direction parallel to the axis of pivoting of said rotor, to move said rotor and said stator axially closer or further away from each other.

9. The regulating mechanism according to claim 1, wherein said conductive rotor part, said magnetized rotor part, said conductive stator part and said magnetized stator part has a variable thickness allowing modulation of the amplitude of dissipated energy.

10. A timepiece escapement mechanism including at least one escape wheel, wherein said escapement mechanism includes a regulating mechanism according to claim 1, arranged to limit the effect of accelerations on said escape wheel.

11. A timepiece movement including at least one escapement mechanism according to claim 10.

12. A watch including at least one timepiece movement according to claim 10.

13. The regulating mechanism according to claim 1, wherein, when said rotor and said stator are superimposed in the annular area of magnetic interaction, the at least one raised area is asymmetrically located with respect to the pivot axis of the rotor in the annular area.

* * * * *